United States Patent [19]

Szedzinski

[11] Patent Number: 5,060,356

[45] Date of Patent: Oct. 29, 1991

[54] COVERING PART FOR UTILIZING ELEMENTS SUCH AS CLOTHING BUTTONS

[76] Inventor: Manfred V. Szedzinski, Burghaldenstrasse 8, D-7140 Ludwigsburg, Fed. Rep. of Germany

[21] Appl. No.: 474,006

[22] PCT Filed: Apr. 14, 1988

[86] PCT No.: PCT/EP88/00317

§ 371 Date: Apr. 13, 1990

§ 102(e) Date: Apr. 13, 1990

[87] PCT Pub. No.: WO89/03645

PCT Pub. Date: May 5, 1989

[30] Foreign Application Priority Data

Oct. 23, 1987 [DE] Fed. Rep. of Germany ..... 3735867

[51] Int. Cl.[5] ..... A44B 1/14

[52] U.S. Cl. ..... 24/113 R; 24/113 MP

[58] Field of Search ..... 24/113 R, 113 MP, 100, 24/105, 453; 5/472

[56] References Cited

U.S. PATENT DOCUMENTS

| | | | |
|---|---|---|---|
| 1,180,104 | 4/1916 | Barnes | 24/113 MP |
| 2,662,259 | 12/1953 | Koehl | 24/113 R |
| 2,751,654 | 6/1956 | Armbruster . | |
| 2,776,434 | 1/1957 | Ellestad | 24/113 MP |
| 2,850,779 | 9/1958 | Dobro . | |
| 2,880,487 | 4/1959 | Ryan | 24/113 MP |
| 2,883,725 | 4/1959 | McDonough, Jr. | 24/113 MP |
| 3,316,601 | 5/1967 | Ryan | 24/113 MP |
| 3,343,230 | 9/1967 | Darvie . | |
| 3,353,231 | 11/1967 | Levine | 24/113 MP |
| 3,584,349 | 6/1971 | Shubart | 24/113 MP |
| 3,757,388 | 9/1973 | Wolny | 24/113 MP |
| 3,777,336 | 12/1973 | Anderson | 24/113 MP |

FOREIGN PATENT DOCUMENTS

| | | | |
|---|---|---|---|
| 657867 | 2/1963 | Canada | 24/113 MP |
| 114762 | 1/1900 | Fed. Rep. of Germany . | |
| 607884 | 1/1935 | Fed. Rep. of Germany . | |
| 1932670 | 1/1971 | Fed. Rep. of Germany . | |
| 2298289 | 8/1976 | France . | |
| 2567005 | 1/1986 | France . | |
| 657762 | 9/1986 | Switzerland . | |
| 2199632 | 11/1983 | United Kingdom | 24/113 R |

*Primary Examiner*—Victor N. Sakran

*Attorney, Agent, or Firm*—Barnes & Thornburg

[57] ABSTRACT

A decorative covering part for a utilitarian element such as a clothing button, a shirt cuff or blouse cuff button, or an ornamental element, comprises an insertion opening for the utilitarian element bounded on at least two facing sides by a gripping surface for the utilitarian element. A distance between sides of the insertion opening decreases, in at least one region, in the direction opposite to the direction of insertion. The covering part can therefore be made from any material, including rigid materials, and can be easily manipulated.

31 Claims, 5 Drawing Sheets

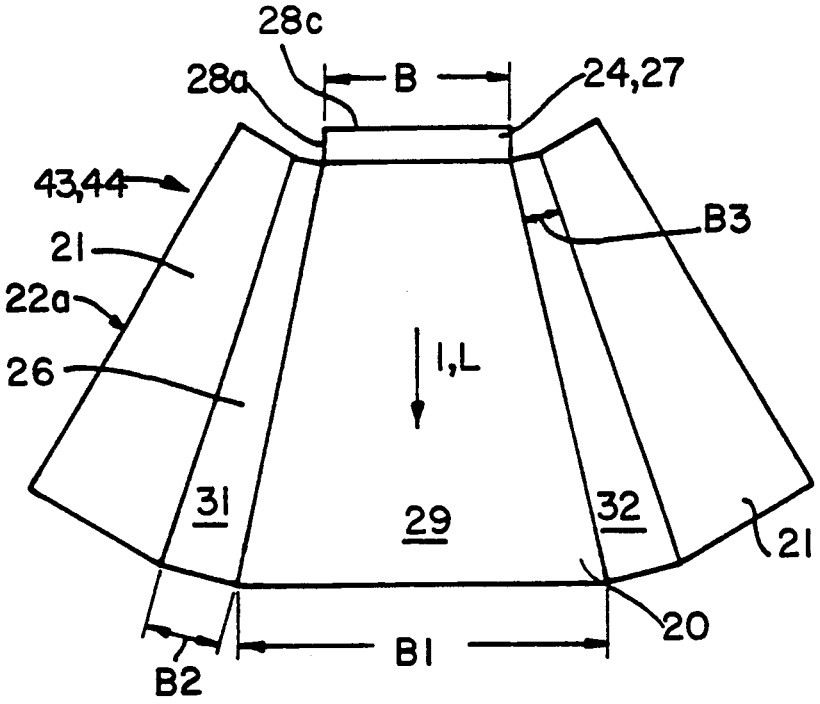
Fig. 7
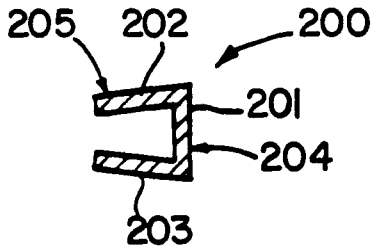
Fig. 7a
Fig. 8
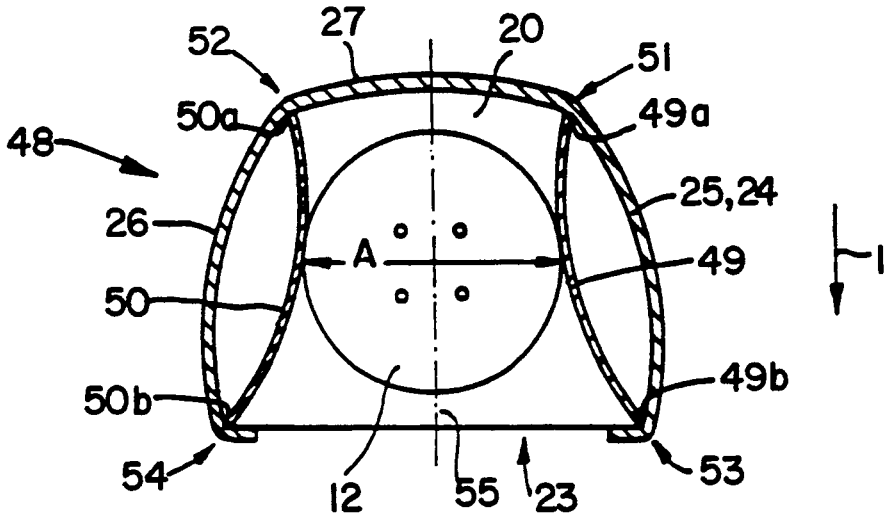

COVERING PART FOR UTILIZING ELEMENTS SUCH AS CLOTHING BUTTONS

BACKGROUND AND SUMMARY OF THE INVENTION

The invention relates to an ornamental cover for an operating element such as a clothing button arranged on a shirt or blouse cuff or an ornamental element wherein the ornamental cover is adapted to be mounted and demounted on the operating element.

It is well known to have conventional ornamental buttons for shirt or blouse cuffs which comprise a plate-like top portion with a bottom thereof. The bottom has secured thereto a central stem portion with a free end having a two-armed lever which is pivotally mounted to an axle extending parallel to said top portion and being secured to said central portion and being designed as a stud or the like. Ornamental cuff links of the above type are adapted to be used with shirts or blouses having cuffs with end portions being formed with button holes. Long-sleeve shirts and blouses normally have cuffs with one end portion being formed with a button hole and the other end portion having a button. Therefore, the conventional ornamental cuff links cannot be used with such shirts and blouses.

A cover for ornamenting conventional shirt cuff links or clothing buttons is known from U.S. Pat. No. 3,343,230. Here the cover comprises a first plate and a second plate which is formed as a fork and which is opposite to the bottom of said first plate. For the purpose of simplification the fork plate will be referred to only as a fork. The button is clamped between the plate and the fork. The bottom of the plate and the top of the fork that faces the bottom of the plate thus each provide one clamping surface for the button. As illustrated therein, the fork is in all dimensions narrower and shorter than the plate and over a certain extent of its breadth, it is integrally formed with the plate by means of a frame which is greater than the above-mentioned forked portion and which extends vertically downward from the edge of the plate. The fork is inclined with respect to the plate in such a manner that a free fork end is in closer proximity to the plate than the other fork end. Accordingly, the fork and the plate must be allowed to bend from each other prior to the mounting on the button. Therefore, the variety of materials for the cover is limited to elastic materials, unless an early breakage of the relatively narrow abutting area of fork and plate or frame is accepted. However, many materials for ornamental elements such as platinum allows and ornamental stones are brittle or rigid. Consequently, it is not possible to manufacture the described cover from merely these materials. At best these materials may be coated on the cover, but this method is intricate and does not comply with the demand for quality of many persons. In addition, in the cover according to U.S. Pat. No. 3,343,230, the fork is shorter than the plate, and thus the fork cannot be easily operated to detach the cover from the button.

Considering the above prior art it is the object of the invention to provide a cover of the aforementioned general type which may be manufactured of any material, has a long service life, and which is easy to handle and as versatile as possible.

This object is attained by a cover which is formed with a receiving portion for the operating element which has at least two points facing each other to define two facing clamping surfaces for the operating element and wherein a distance between the at least two clamping surfaces decreases at least partially along a mounting direction of the cover. As the distance between the clamping surfaces decreases along the mounting direction (it is not the smallest at the beginning of the cover), the cover may thus be mounted on buttons of various shape. The clamping surfaces need not permit elastic bending with respect to each other. Consequently they may extend rigidly with respect to each other. This means that they need not be linked to each other by means of a film link or the like, but may be rigidly connected with each other along whole edges, for example from castings or elements carved out of stone or wood. Accordingly, the clamping surfaces of the cover may have a great thickness which gives the cover rigidity. If the two clamping pieces consist of different materials, than their hold can be obtained by a plastical deformation of the one of those pieces which is softer than the other. With uniform materials, clamping can occur by tilting one of the two pieces with respect to the other. Both with elastic and with rigid piece parts it is possible to have two clamping surfaces. One or both of these clamping surfaces may be inclined with respect to an imaginary plane extending in a longitudinal direction through the cover. If only one clamping surface is inclined and an operating element or ornamental element is used which has at least one flat side which is free to a great extent (as in the case of a conventional cuff link) the cover may be very safely held in place on the element. This is true because with the elements non-inclined surface, the cover can contact the whole flat surface of the element, that is it will contact the element over a large area. In case of an element having a substantially rectangular cross-section (such as a conventional cuff link), the inclined clamping surface can act on the rear upper button edge along the mounting direction. Where a calotte-shaped button is used, the clamping surface could act on the peak thereof. If both clamping surfaces are inclined and the element has a rectangular cross-section, clamping can be effected on the rear edges of the element along the mounting direction. For all these variations retention of the cover is obtained by having the clamping surface extend lengthwise and breadthwise of the cover.

Furthermore, it is possible to provide, either in addition to or instead of the clamping surfaces extending lengthwise and widthwise, two clamping surfaces which extend in the direction of height of the cover. Either only one, or both of these clamping surfaces may be inclined with respect to an imaginary plane extending through the cover in the direction of height thereof. It is also possible to provide several pairs of clamping surfaces extending in the direction of height such as at a long and at a broad side of a quadrangular cover. When mounting the cover from above, the cover must be open at its bottom. The cover can be safely held on the element if lengthwise and widthwise clamping surfaces are provided in combination with clamping surfaces extending heightwise. In this case the cover must have a front opening or be adapted to be opened in front.

Such an opening can be provided where the cover comprises a top plate and a base plate facing said top plate and connected therewith by an opening, or adapted to be opened, at a base section which forms the beginning of the cover along the mounting direction. The base plate can include an aperture extending from the beginning base section of the cover along the mounting direction.

In the case of an element having a rectangular cross-section, clamping may be effected on the rear edges of the element along the mounting direction. For an element having a circular or oval contour (such as a conventional cuff link), it is proposed to provide clamping at two points on the element which are at least approximately opposed diametrically and with clamping surfaces extending in the direction of height.

As indicated above, clamping surfaces that extend lengthwise, widthwise and heightwise are utilized in the cover and if the inside cover walls that provide the clamping surfaces have outer surfaces which extend in parallel relationship to the clamping surfaces, the outer surfaces of the clamping surfaces and the cover walls could have parallel surfaces. Here the whole cover could be manufactured from one or several metal sheets that may be bent. In this case, the cover may have a shape which includes cants and edges or ears which are arched over. This can ensure that the cover is safely held in place on the element and allows for the cover to have an advantageous unusual styling.

The cover may have an outer shape which differs from the shape and position of the clamping surfaces. It is also possible to provide (either in addition to or instead of the above-specified clamping surfaces) clamping surfaces extending in the direction of height of the cover wherein the distance between said clamping surfaces are at least partially smaller than the external dimension of one or several holding element(s) for the operating element. In the case of a button held by threads, the clamping surfaces can interact with the threads. In the case of a pass-through button with a base shaft, the clamping surfaces can interact with a base shaft portion of the button.

A cover in which the clamping surfaces extend heightwise and with a smaller distance therebetween than the holding element of the button, can be held in place at the holding element and thus at the operating or ornamental element in a strikingly simple manner. The cover need only include a one-wall element such as a plate which includes a slot-like aperture which does not cover the overall length of the plate and which aperture itself provides the clamping surfaces by means of its limiting walls extending in longitudinal direction. The element may also be pan-shaped or otherwise open on top. With the first-mentioned embodiment, the bottom of operating or ornamental elements may be covered and with the second embodiment the bottom and the side surfaces can be covered. In both cases the operating or ornamental element is optically set off. However, the cover may also be formed as a hollow element which is closed to a great extent and has an aperture that extends along a base plate.

When clamping surfaces extending in the direction of height of the cover and wherein the distance between said clamping surfaces are at least partially smaller than the external dimension of one or several holding element(s) are provided, their clamping surfaces may extend in parallel relationship to each other in order to safely hold the cover at the holding element(s). But if the distance between the surfaces decrease, the cover can still be safely held at the holding element(s). Furthermore, one of the clamping surfaces may be provided by the cover itself by elements which are disposed at (or in) the cover. In order to provide a specific shape of the cover with respect to the operating or ornamental element, one can provide that the clamping surface extend diagonally with respect to the cover.

The shape of a clamping surface in accordance with the invention may be structurally defined in an advantageous manner in that at least one clamping surface extends at an angle, which opens along the mounting direction of the cover by approximately 5 to 30 degrees as defined by an imaginary line which extends in longitudinal mounting direction of the cover and which represents a side of a right triangle when the clamping surface is the hypotenuse. The clamping surface may extend in a single plane, that is, it may be flat. In another variation the clamping surface may include corrugations or serrations. A clamping surface that varies heightwise may also be further developed in this manner. In the last-mentioned variations, the clamping surface need not necessarily extend at an angle to a line which extends in longitudinal direction through the cover. The projecting curvatures of the corrugations (or the points of the serrations) effect the decreasing distance between the clamping surfaces along the mounting direction when crests and troughs are arranged so as to not face each other. Thus it is possible to attain a holding function. In both cases the crests and troughs need not necessarily have the same dimension along the longitudinal direction of the cover. The same applies to serrations of course. Particularly for embodiments with corrugations and serrations, it is possible to manufacture the clamping surfaces or clamping walls of elastic material. If they were manufactured of hard material such as steel or a jewel, one would include the risk of damaging the operating or ornamental element and/or its holding element(s). The clamping surfaces may each be provided by at least one element disposed at (or in) the cover. Here the element may be a leaf spring. It may also be a block of an elastic material such as rubber or synthetic material. For clamping surfaces that vary in height, bars of elastic material may be used.

Where the cover comprises a top plate and a base plate, facing said top plate and connected therewith by an opening or a cover adapted to be opened at a base section which forms the beginning of the cover along the mounting direction. The base plate can include an aperture extending from the beginning base section of the cover along the mounting direction, then the aperture permits the holding element for the operating or ornamental element to pass through the bottom of the cover to secure the button to another element. In the case of a clothing button, the thread can pass through the cover to secure the button to the article of clothing. If the aperture is designed with clamping surfaces extending in the direction of height of the cover and wherein the distance between said clamping surfaces are at least partially smaller than the external dimension of one or several holding element(s) for the operating element, a holding function can be obtained. If the aperture extends over the approximate total length of the cover, here the above-proposed clamping function will be possible in the rear area of the operating or ornamental element.

To prevent an undesired loss of the cover and/or for stylistic reasons, a flap can be provided to close a base opening that accommodates sliding of the cover over the operating element. Manufacturing of the cover by extruding, deep-drawing, bending or casting can occur when it includes cants, edges and/or areas which are arched outwards.

Other objects, advantages and novel features of the present invention will become apparent from the following detailed description of the invention when considered in conjunction with the accompanying drawings.

BRIEF DESCRIPTION OF THE DRAWINGS

FIG. 7 is an unfolded view of the second cover embodiment;

FIG. 7*a* is a cross-section of a sectional bar for use in a cover;

FIG. 8 is a longitudinal section through a third cover embodiment;

DETAILED DESCRIPTION OF THE DRAWINGS

Figure 1:
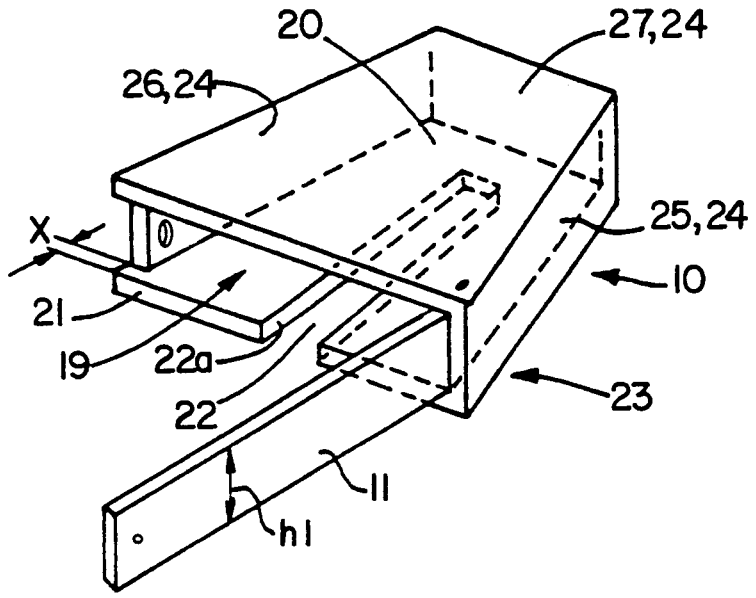
FIG. 1 is a perspective view of a first cover embodiment.
Figure 2:
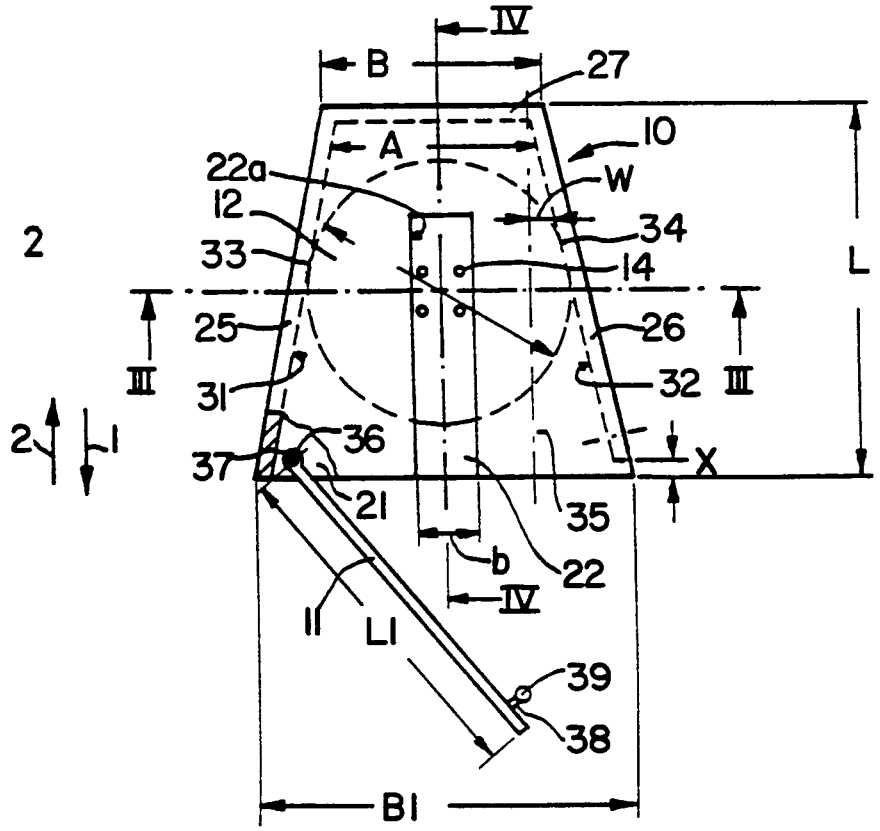
FIG. 2 is a bottom view of the cover of FIG. 1, as mounted on a first clothing button.

The ornamental cover 10 illustrated in FIGS. 1 to 4 resembles a segment of a frustum of a pyramid with a rectangular base. Except for a closure flap 11, which will be described thereinafter, it is manufactured as one piece from silver.

By reason of its above-mentioned pyramidal shape and its being manufactured of silver, the cover creates an ornamental element by itself as well as for a button 12 contained thereby. Threads 13 are guided through openings 14 in the button 12 to secure the button to a first end portion 15 of a shirt cuff 16. A second end portion 17 of the shirt cuff 16 is formed with a buttonhole 18 to accommodate passage of the button 12 therethrough. As usual, the button 12 is made of a synthetic material, is circular shaped and has a rectangular cross-section.

The cover 10 includes a receiving open portion 19 for locating the button 12. The opening 19 has an upper side top plate 20. The top plate 20 has the contour of an isosceles trapezoid. The length L of the trapezoid is substantially greater than the diameter D of the button 12. In the illustrated embodiment it is about 25 mm. The smallest breadth B of the trapezoid is about 12 mm, whereas the greatest breadth B1 is about 21 mm. A base plate 21 is provided with the same basic shape and dimensions as the top plate 20 and is spaced in parallel relationship from the top plate 20 by about 3 mm. The base plate 21 includes an aperture 22 which covers about four fifths the overall length of the cover and which begins at its base section 23. The cover 10 is mounted on the button 12 by being slid in the direction of arrow 1 from the base side 23 of the cover 10. In this embodiment, the aperture 22 is rectangularly shaped and has straight limiting walls 22*a* and a breadth b which amounts to about 3 mm. This breadth corresponds to the distance between the holes 14 in the button 12 and thus to the distance between the button threads 13 so as to permit the threads to freely pass through the base plate 21.

Except for area of the base 23 adjacent the flap 11, the top plate 20 and the base plate 21 are interconnected by means of a frame 24. The frame 24 includes two side walls 25 and 26 having a length L and height H and one transverse wall 27 extending in the direction of breadth B and with the same height H. The side walls 25 and 26 as well as the transverse wall 27 have a rectangular contour, because in this embodiment the top plate 20 and the base plate 21 extend in parallel relationship to each other. All plates 20, 21 and walls 25, 26, 27 are integrally cast of silver having a thickness of approximately 0.5 mm to 2 mm. Accordingly, the plates 20, 21 and the walls 25 to 27 extend rigidly with respect to each other. At best, they may be elastically bent from each other only after exertion of very great pressure.

Figure 3:
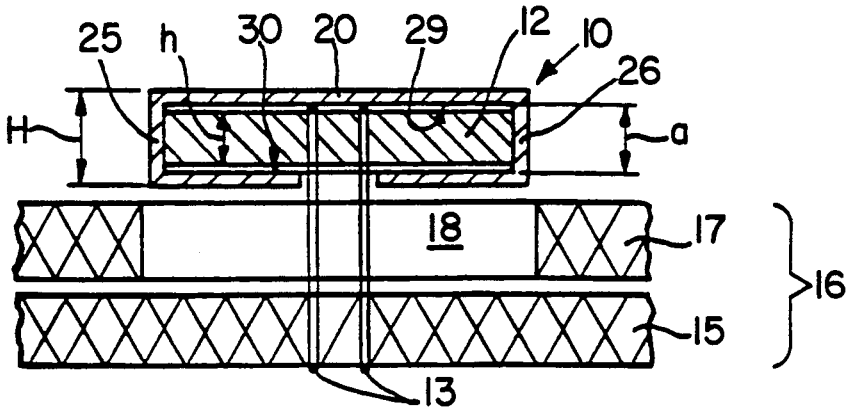
FIG. 3 is a section taken on the line III—III of FIG. 2.
Figure 4:
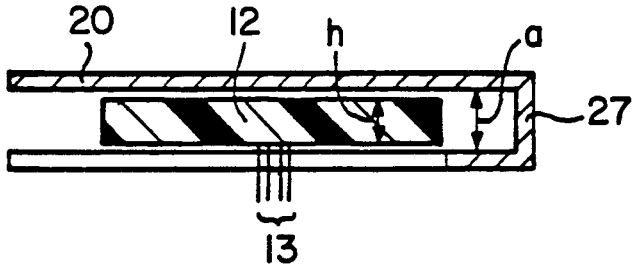
FIG. 4 is a section taken on the line IV—IV of FIG. 2.

As particularly shown in FIG. 3, the whole inner surface 29 of the top plate 20 is spaced by an amount (a) from the inner surface 30 of the base plate 21. The amount (a) is slightly greater than the height (h) of the button 12 (see FIGS. 3 and 4 which are illustrated greatly enlarged). The cover 10 is held on the button 12 only by means of the side walls 25 and 26. Because of the above-described shape of the plates 20 and 21 and side walls 25 and 26 connected with said plates 20 and 21 along their longitudinal edges, the distance (A) between the side walls 25 and 26 decreases continuously along the direction of arrow 2 from the base 23 to the transverse wall 27, representing the end of the cover 10. The distance (A) at the rear end 27 of the cover 10 is smaller than the diameter (D) of the button 12. The inner surfaces 31 and 32 of the side walls 25 and 26 thus provide clamping surfaces for the button 12 at two line points 33 and 34 which are diametrically opposed along the direction of height (h) of the button 12. Because of the different breadth dimensions (B) and (B1) of the plate 20 and thus of the whole cover 10, the clamping surfaces 31 and 32 of this embodiment extend at an angle (W) (open in mounting direction 1 of the cover 10) of approximately 10 degrees with respect to an imaginary line 35 which extends in longitudinal direction (L). Line 25 represents one side of a right triangle with the clamping surface 31 or 32 on the hypotenuse. Consequently, the cover 10 is held on the button 12 in a strikingly simple manner by being clamped. A flap 11 provides additional safety against an undesired removal from the button 12 from the cover 10. The flap 11 has a substantially rectangular contour and a height (h1) which is slightly smaller than the distance a between the inner surfaces 29 and 30 of top plate 20 and a base plate 21. It has a length (L1) which is greater than the breadth (B1) of the cover 10 in the area of the flap 11. The flap 11 is provided with an eyelet 36 at one end by means of which it is pivotally mounted to a bolt 37 which is disposed in the proximity of the side wall 25 between the top plate 20 and the base plate 21. At its second end, flap 11 is provided with a lug 38 which has a substantially cylindrical shape that ends in a ball 39. Pivoting the flap 11 about the bolt 37 will permit the flap 11 to contact the outside of the side wall 26 by the ball 39 of the lug 38. At its front end 23, the side wall 26 is recessed by the amount (x) which corresponds to the thickness of the flap 11. Accordingly, the flap 11 rests between the inner surfaces 29 and 30 of the cover 10 without projecting out therefrom over the length (L) thereof. Consequently, after the closing of the flap 11, the cover 10 cannot slip off the button 12 and be lost. When detaching the cover 10 from the button 12, the ball 39 represents an easily seizable handle for moving the flap 11. After pivoting the flap 11 about the bolt 37, the cover 10 may be removed from the button 12 in arrow direction 2 if desired.

Figure 5:
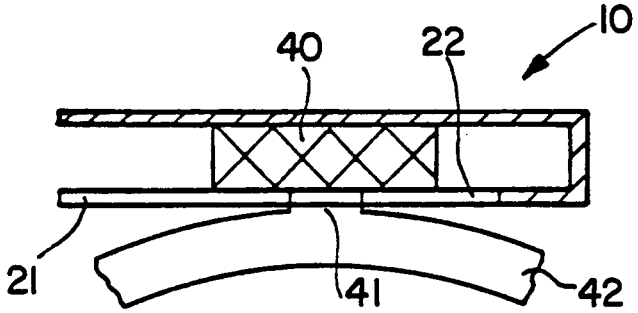
FIG. 5 is a section in accordance with that of FIG. 3 wherein the cover is mounted on an ornamental element.

FIG. 5 shows the cover 10 as mounted on an ornamental element 40. In this embodiment the ornamental element 40 is a circular disk-shaped jewel which is secured to a gentleman's ring 42 by means of a central portion 41. In this manner, the appearance of the gentleman's ring 42 has been reversibly modified in a novel manner. This is particularly impressive when the thus modified gentleman's ring is worn in combination with a shirt which is equipped with similar covers 10 as described above.

Figure 6:
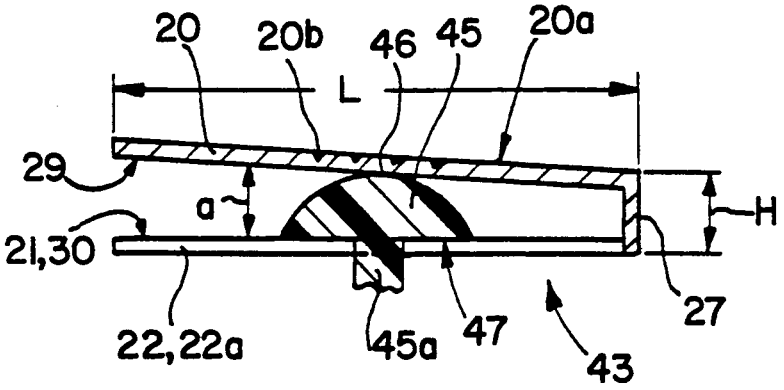
FIG. 6 is a section in accordance with that of FIG. 3 through a second cover embodiment, as mounted on a clothing button.

The cover 43 illustrated in FIGS. 6 and 7 substantially resembles the above-illustrated and described cover 10. Like details of both embodiments are identified with like reference numerals and for their description reference should be had to FIGS. 1 to 4. The plates 20, 21 and walls 25, 26, 27 of this embodiment, however, have been cut or punched as one piece of a completely flat piece of silver sheet 44 (see FIG. 7) having a thickness of about 0.5 mm and are provided with an engraving 20*b* in the area 20*a* later representing the upper side of the top plate 20. The plates 20, 21 and walls 25, 26, 27 are bent to form the cover 43 shown in FIG. 6. The three edges 28*a*, 28*b* and 28*c* of the transverse wall 27, which are unattached after the forming of the cover 43 by bending, are soldered to the front edges of the side walls 25 and 26 and the base plate 21. In a further possible variation, the transverse wall 27 may be omitted. In this case, the cover 43 would be open at the rear. In this embodiment, the aperture 22 extends over the total length (L) of the cover 43; is in trapezoidal form and has its greatest breadth at (B1). The plates 20, 21 and walls 25, 26, 27 are arranged substantially rigidly with respect to each other. They may be elastically bent from each other only after exertion of a relatively great pressure. As particularly shown in FIG. 6, the inner surface 29 of the top plate 20 is spaced from the inner surface 30 of the base plate 21 by an amount which decreases towards the rear end of the cover (transverse wall 27). This is due to the fact that the side walls 25 and 26 of this embodiment are trapezoidal form. Therefore, the cover 43 resembles (in plan view) a hollow frustum of a pyramid having a trapezoidal form base. In the front base area (starting at mounting direction 1), the side walls 25 and 26 have a breadth (B2) of 5 mm, and in the rear area they have a breadth (B3) of 1.5 mm. The dimensions of breadth (B) and (B1) of the plate 20 are equal to those described on the basis of FIGS. 1 to 4. Accordingly, two clamping surfaces are provided which extend in the direction of length (L) and breadth (B) of the cover 43, that is, the inner surfaces 29 and 30 of the top plate 20 and the base plate 21, as well as two clamping surfaces which extend in the direction of height (H) of the cover 43 (the inner surfaces 31 and 32 of the side walls 25 and 26).

Accordingly, the cover 43 is held in place on the cabochon-shaped button 45, which includes a base portion 45*a* as bottom holding element. The holding is through inner surfaces 31 and 32 of the side walls 25 and 26 and the inner surfaces 29 and 30 of the top plate 20 and the base plate 21. Therefore, clamping is effected at two diametrically opposed top and bottom points of the button 45, the point 45 with the highest curvature and the other point with the whole button base 47.

On the basis of the shape of the aperture 22 which has been described above, the distance between the limiting walls 22*a* thereof decreases from the base 23 along the mounting direction 1. The trapezoidal shape of the aperture 22 was chosen such that the breadth thereof (at about half the length L) equals the diameter of the base portion 45*a* of the button 45. Therefore, additional clamping is effected between the aperture limiting walls 22*a* and button holding base portion 45(*a*).

If the button is held to a shirt by means of threads instead of a base portion 45(*a*), sectional bars of elastic synthetic material or the like might be provided which are adapted to be slid onto said limiting walls 22*a* in order to avoid the risk of damaging the threads by the limiting walls 22*a*. One of said sectional bars is illustrated in FIG. 7*a*. The bar 200 has an approximately C-shaped cross-section and includes two legs 202 and 203 which are connected by means of a connecting portion 201 and which are adapted to be elastically bent with respect to each other. The bar has the same length as the limiting wall 22*a*, the connecting portion 201 has the same height as the limiting wall 22*a*, and the legs 202 and 203 have approximately half the breadth of the base plate sections 21 (not illustrated). The outer surface 205 of the upper leg 202 bears against the button base and effects additional clamping of the button.

It is also possible to coat the limiting walls 22*a* with elastic material, for example by adhesively attaching a tape of synthetic material or by applying synthetic material by injection-moulding.

Both with and without bars or coatings, the cover 43 is absolutely and safely held in place on the button 45. A similarly good holding effect would also be attained on a circular disk-shaped button. In this case, clamping would be effected on the rear upper button edge by means of the inclined top plate 20. Otherwise clamping would be provided at the same points as in the case of the cabochon-type button 45.

In the embodiment illustrated in FIG. 8, the cover 48 is similarly shaped as the cover 10 illustrated in FIGS. 1 to 4, but includes slightly outwardly curved side walls 25 and 26 and a slightly outwardly curved transverse wall 27, in order that the formed frame 24 circumscribes three curves. Here the cover 48 has been cut from a semi-precious stone. The top plate 20 and the not illustrated base plate are shaped correspondingly. The essential feature of the cover 48 is that clamping is not effected by means of its walls but by two leaf springs 49 and 50 disposed within said cover. The leaf springs 49 and 50 are loosely inserted in the cover 48. With their first ends 49*a* and 50*a* they rest against the inner sides of the rounded edges 51, 52 between the side wall 25 and the transverse wall 27 as well as between the side wall 26 and the transverse wall 27. With their second ends 49*b* and 50*b* they rest against the inner sides of rounded edges 53 and 54 which are provided by the side walls 25 and 26 in the base area 23 of the cover 48. The leaf springs 49 and 50 are concavely curved with respect to the imaginary longitudinal central axis 55 of the cover 48. This means that their distance (A) decreases from the base 23 in the mounting direction 1 up to the center of the cover 48. Because of pre-tension, the springs act towards the longitudinal central axis 55. Therefore, they are able to act on an angular button at two longitudinal side walls thereof, or on a round button 12, as illustrated in FIG. 8, at two diametrically opposed points thereof. In each case the holding function is accomplished by clamping.

It is obvious that the cover 48 might also be shaped in a different manner. The only necessity in this embodiment, however, are abutting surfaces or abutting edges for the leaf springs 49 and 50. But even they might be omitted if studs or the like were provided for the spring ends 49*a*, 50*a*, 49*b*, 50*b*. At its initial area 23, the cover 48 may be closed by a flap (not illustrated) of a resilient synthetic material which has been colored in accordance with the color of the semi-precious stone used for the cover 48 and which is adapted to be clipped between the bent side wall ends (edges 53 and 54).

Figure 9:
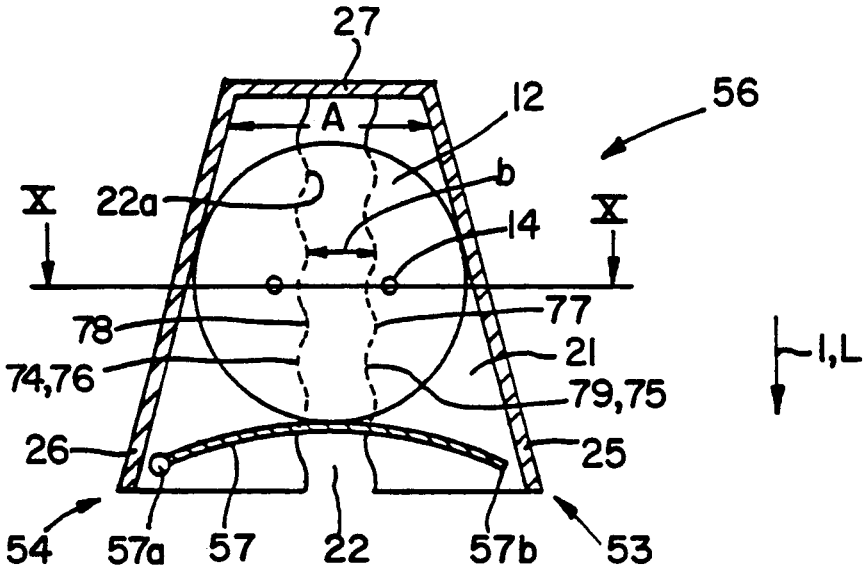
FIG. 9 is a longitudinal section through a fourth cover embodiment.
Figure 10:
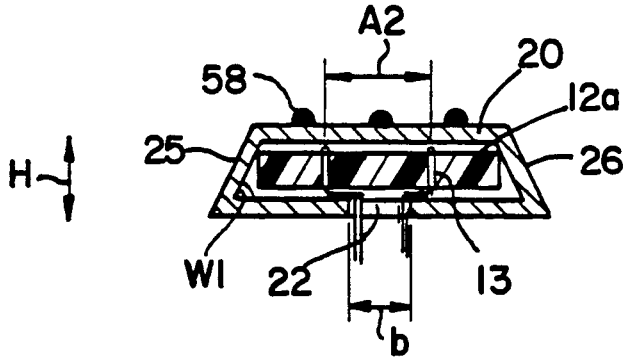
FIG. 10 is a section taken on the line X—X of FIG. 9.

In the cover 56 illustrated in FIGS. 9 and 10, the side walls 25 and 26 and the transverse wall 27 are not curved. The distance A between the side walls 25 and 26 also decreases as in the embodiment according to FIGS. 1 to 4. As shown in FIG. 10, the side walls 25 and 26, however, extend at an angle to the plates 20 and 21 which deviates from a right angle. In a particular embodiment, they extend at an angle (W1) of approximately 70 degrees with respect to the top plate 20. By means of this angled slope, clamping is attained at two diametrically opposed points of the upper edge 12*a* of the circular disk-shaped button 12. In the main, a holding function by clamping is accomplished by a leaf spring 57 element disposed within the cover. Contrary to the embodiment according to FIG. 8, there is provided only one leaf spring 57 which is not arranged in the side wall area but rather is arranged in the initial area 23 of the cover 56. A first end 57(*a*) of the leaf spring 57 is soldered to the top plate 20 of the cover 56 in the corner area 54 thereof. Its other second and free end 57*b* and it is concavely curved with respect to the transverse wall 27. It extends almost up to the corner area 53. It thus serves at the same time as a cover or flap for the initial area 23 of the cover 56. Through its pretension it acts towards the transverse wall 27 to thereby urge the button 12 against the side walls 25 and 26. The removal of the cover 56 is effected after manual deflection of the second end 57*b* of the leaf spring 57 in arrow direction 1.

As further shown by FIGS. 9 and 10, the limiting walls 22*a* of the aperture 22 of this embodiment are provided with surfaces 74 and 75 which are corrugated in the direction of length (L) and height (H). Crests 76, 77 and troughs 78, 79 always face each other in parallel relationship. The width (b) of the aperture 22 is smaller than the distance (A2) between the holding threads 13 which pass through the holes 14 in the button 12 (greatly enlarged in FIG. 10). Accordingly, the cover of this embodiment, similar to the cover 43 described on the basis of FIGS. 6 and 7, is additionally held in place by being clamped between the aperture limiting walls 22*a* and the button holding elements (threads 13). The "meandering" extension of the aperture 22 at the limiting surfaces 74 and 75 as described and illustrated in FIG. 9, effectively prevents the cover 43 from sliding off the button holding elements, even if the leaf spring 57 was no longer effective. This meandering configuration of the aperture 22 can of course be used with any of the previously mentioned embodiments.

As further shown by FIG. 10, the cover 56 includes on the top plate 20 several small jewels 58 as ornamental elements. This feature also can be used with any of the embodiments.

Figure 11:
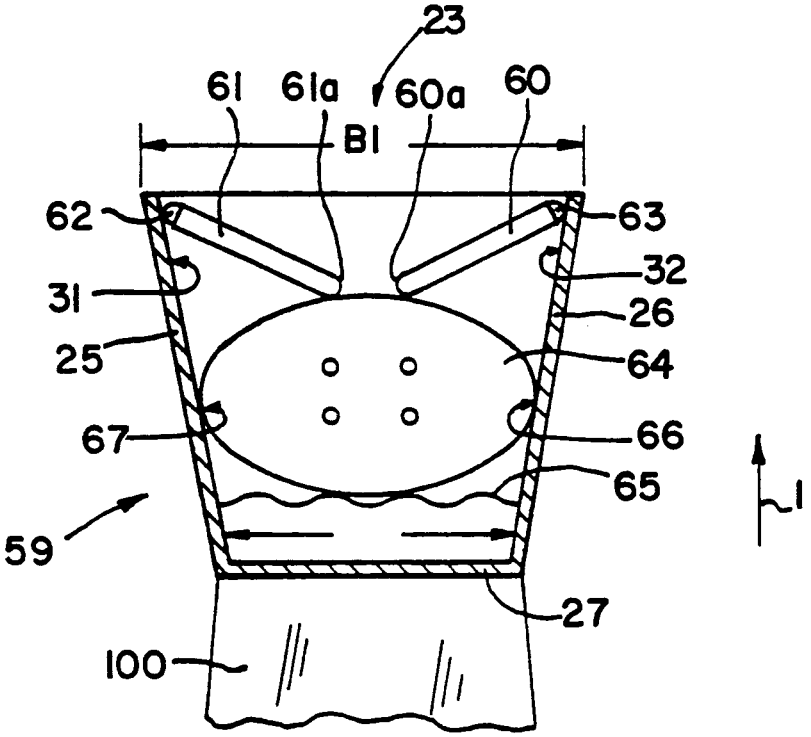
FIG. 11 is a longitudinal section through a fifth cover embodiment.

The cover 59 illustrated in FIG. 11 resembles that shown by FIGS. 9 and 10. Here instead of one leaf spring however, it includes two flaps 60 and 61 which each have a hinge 62 or 63 (similar to doors of kitchen furniture) which close automatically on the basis of spring tension. The flaps 60, 61 are secured to the side walls 25 and 26 of the cover 59 and in the proximity of the initial area 23 thereof.

The flaps 60 and 61 each have approximately half the length of the breadth (B1) of the cover 59 in the initial base area 23. Their ends 60*a* and 60*b* contact (in relatively close proximity to each other) two points of the oval button 64 of this embodiment. In addition, the cover 59 includes a corrugated leaf spring 65 which extends in the proximity of the transverse wall 27 between the side walls 25 and 26. The flaps 60 and 61 interact with the leaf spring 65 in such a manner that at two diametrically opposed points 66 and 67, the button 64 is urged against the clamping surfaces 31 and 32 which are provided by the side walls 25 and 26. These surfaces are described on the basis of FIGS. 1 to 4 and extend along the mounting direction 1 at a decreasing distance (A) with respect to each other. Thereby a very safe clamping function is attained. The detachment of the cover 59 from the button 64 or from any other button, or ornamental element may be effected after the deflection of the flaps 60 and 61 in arrow direction 1. This retainer expedient can be used on any of the above embodiments. In this cover 59 too, a further covering of the initial base area 23 may be dispensed with.

The transverse wall 27 of the cover 59 has a tie element 100 secured thereto. As the appearance of the cover 59 resembles very much a tie-knot, the two elements 59 and 100 may be easily considered to be a tie. On the basis of the design of the cover 59 in accordance with the invention, the tie may be put on and off very easily and quickly, and is held in place safely.

It is obvious that the cover 59 may be ornamented itself, it may be ornamented with jewels or the like, or it may be covered with the material of which the tie element 100 is made.

The cover 59 or another cover in accordance with the invention may also serve as a body or base for a bow tie, bow or the like. Furthermore, it may also serve as a substitute for a tie, bow tie or bow.

Figure 12:
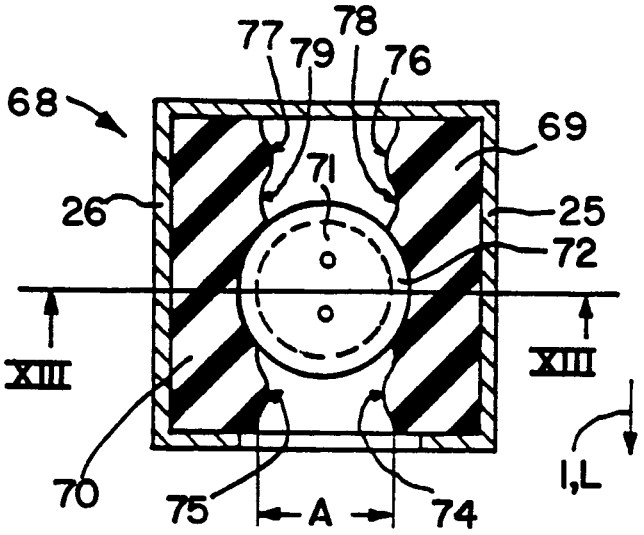
FIG. 12 is a longitudinal section through a sixth embodiment of the cover.
Figure 13:
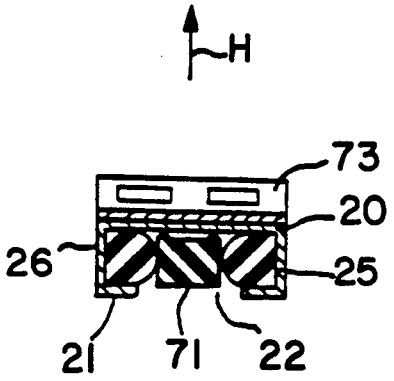
FIG. 13 is a section taken on the line XIII—XIII of FIG. 12.

Similar to the cover 48 illustrated in FIG. 8, the cover 68 according to FIGS. 12 and 13 also includes two elements 69 and 70 which are disposed in the cover and which extend between the side walls 25 and 26 and the top plate 20 and the base plate 21. The cover 68 in this embodiment is column-shaped and has a rectangular base. Said two elements 69 and 70 serve for clamping the button 71, which in this embodiment has a circular elevation 72 on the upper edge and otherwise is circular disk-shaped like the button 12. The cover 68 is cast of a synthetic material. It includes a rectangular top plate 20 which has a technical instrument 73 of equal size mounted to an upper side. The instrument can be a watch. The likewise rectangular base plate 21 includes a slot 22 which extends over the total length of the cover and which is broader than in the above-indicated embodiments.

The elements 69 and 70 are two substantially identically shaped blocks of flexible synthetic material. They each include a corrugated surface 74 or 75 extending in longitudinal direction (L) and in the direction of height (H). They are arranged in the cover 68 in such a manner that the surfaces 74 and 75 face each other. Here the crests 76 of one block 69 face the crests 77 of the other block 70 directly, that is, not staggered with respect to each other. The surfaces 74 and 75 provide clamping surfaces for holding the cover 68 in place on the button 71. The distance (A) between said surfaces decreases partially, that is, from each crest 76 or 77 to each trough 78 or 79, along the mounting direction 1. As illustrated in FIG. 12, the blocks 69 and 70 have a length which permits them to safely abut against the transverse wall 27 and the side walls 25 and 26 which are bent at their ends. They have a breadth which permits the clamping surfaces 74 and 75 to extend far into the slot 22 (see FIG. 13). As indicated in FIG. 12, the button 71 thus urges the clamping surfaces 74 and 75 far apart towards the side walls 25 and 26. Accordingly, the clamping surfaces 74 and 75 each rest against the circumferential surface of the button over an angular range of approximately 100 degrees. The cover 68 is thus held securely in place on the button 71. This holding means can likewise be used on other embodiments.

Figure 14:
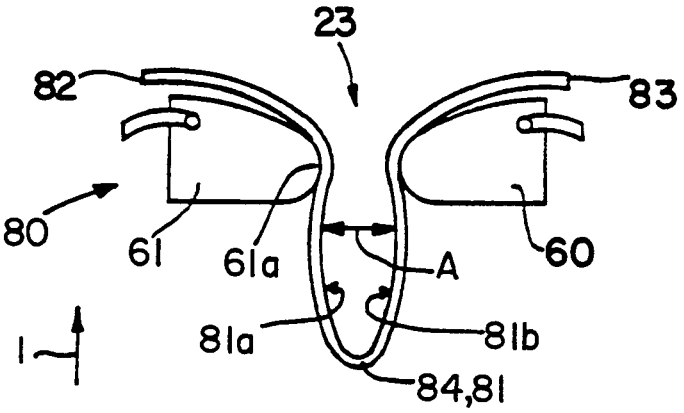
FIG. 14 is a schematic drawing of a seventh cover embodiment.
Figure 15:
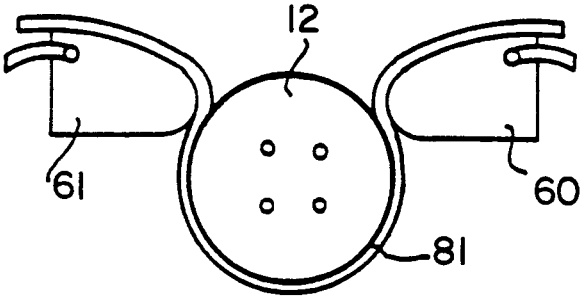
FIG. 15 is the cover shown in FIG. 14 as mounted on a button.

The embodiment according to FIGS. 14 and 15 resembles very much that of FIG. 11. The corrugated leaf spring 65 is replaced by an elastic tape 81 which is secured in the initial area 23 of the cover 80 in front of the flaps 60 and 61 at both ends 82, 83. In its inoperative position it is slack and forms an inward tip 84, because to a certain extent it is compressed by the flaps 60 and 61. Areas of the inner sides 81*a* and 81*b* of the tape 81 (which face each other) are thus spaced from each other by an amount (A) which decreases along the mounting direction 1. After mounting, the button 12 is held under tension by being clamped at its circumferential surface over an angular range of approximately 230 degrees by means of the flaps 60 and 61 and the tape 81 (FIG. 15). Again this type of holder can be used on other of the embodiments.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An ornamental cover for an operating element such as clothing button which is connected to a fabric material by holding means which comprises: a cover with a receiving portion for the operating element;

wherein the receiving portion has at least two points facing each other to each define a clamping surface that engages with side edges of the operating element; and wherein a distance between the at least two clamping surfaces facing each other decreases at least partially along a mounting direction of the cover and the operating element.

2. Cover according to claim 1, wherein the at least two clamping surfaced extend substantially rigid with respect to each other.

3. Cover according to claim 2, wherein the at least two clamping surfaces are made of rigid material.

4. Cover according to claim 1, wherein the at least two clamping surfaces extend lengthwise and breadthwise of the cover.

5. Cover according to claim 4, wherein the operating element has a substantially rectangular cross-section and wherein clamping is effected at least on a rear side edge of the operating element.

6. Cover according to claim 4, wherein the operating element has at least one of circular or oval contour; and wherein clamping is effected at two points on the operating element located at approximately opposed sides of the operating element.

7. Cover according to claim 1, wherein the two clamping surfaces extend heightwise of the cover.

8. Cover according to claim 1, wherein the at least two clamping surfaces extend heightwise of the cover; and wherein the distance between said at least two clamping surfaces is at least smaller than an external dimension of the holding means for securing the operating element.

9. Cover according to claim 8, wherein the at least two clamping surfaces extend at least approximately in parallel relationship to each other.

10. Cover according to claim 8, wherein the distance between the at least two clamping surfaces decreases at least partially along the mounting direction.

11. Cover according to claim 8, wherein at least one of the two clamping surfaces extends diagonally along an inside of the cover.

12. Cover according to claim 1, wherein at least one of the two clamping surface extends at an angle of approximately 5 to 30 degrees with respect to the mounting direction of the cover as defined by an imaginary line which extends longitudinally along the mounting direction and through the cover; and which imaginary line represents a side of a right triangle when the at least one of the two clamping surfaces is the hypotenuse thereof.

13. Cover according to claim 1, wherein one of the at least two clamping surface extends in a single plane.

14. Cover according to claim 1, wherein at least one of the two clamping surface has a corrugated surface.

15. Cover according to claim 14, wherein the corrugated surface is higher at rear edge thereof than at front thereof along the mounting direction.

16. Cover according to claim 4, wherein at least one of the two clamping surfaces is made of elastic material.

17. Cover according to claim 1, wherein at least one of the two clamping surfaces is provided by the cover itself.

18. Cover according to claim 1, wherein at least one of the two clamping surfaces is provided by at least one clamping element that is disposed at a location that is at least one of in and on the cover.

19. Cover according to claim 18, wherein the element is a leaf spring.

20. Cover according to claim 18, wherein the element has a block shape.

21. Cover according to claim 1, wherein the cover comprises: a top plate;

a base plate facing said top plate;

said top and base plates being connected therewith by a frame;

wherein the frame has an open base section which is located at a base which forms a beginning for the mounting direction of the cover; and wherein the base plate includes an aperture extending from said beginning of the cover along the mounting direction.

22. Cover according to claim 21, wherein the aperture extends for approximately a total length of the base plate.

23. Cover according to claim 21, wherein the open base section of the frame is closed by at least one flap.

24. Cover according to claim 23, wherein the at least one flap is linked to the cover by a structural element that extends in a direction of height of the cover; and wherein the at least one flap rests in a clamping manner against an area of the frame facing the sturctural element.

25. Cover according to claim 1, wherein the cover is manufactured as one piece.

26. Cover according to claim 25, wherein the one piece is a bent sheet metal element.

27. Cover according to claim 1, wherein an outer configuration of the cover includes at least one of cants, edges and areas which are arched outwards.

28. Cover according to claim 1, wherein an outer configuration of the cover resembles a frustum of a pyramid in plan view.

29. Cover according to claim 1, wherein the cover is ornamented along at least one side thereof to face a viewer.

30. An ornamental cover for an operating element such as a clothing button comprises:

a cover with a receiving portion for the operating element;

wherein the receiving portion has at least two points facing each other to each define a clamping surface for the operating element;

wherein a distance between at least two clamping surfaces facing each other decreases at least partially along a mounting direction of the cover and the operating element;

wherein the cover comprises a top plate and a base plate facing said top plate, and said top and base plates are connected therewith by a frame;

wherein the frame has an open base section which is located at a base which forms a beginning for the mounting direction of the cover;

wherein the base plate includes an aperture extending from said beginning of the cover along the mounting direction;

wherein the open base section of the frame is closed by at least one flap;

wherein there are two flaps each linked at one end thereor to opposite sides of the frame by a hinge; and wherein other ends of the flaps rest against the operating element.

31. An ornamental cover for an operating element such as a clothing button comprises:

a cover with a receiving portion for the operating element;

wherein the receiving portion has at least two points facing each other to each define a clamping surface for the operating element;

wherein a distance between at least two clamping surfaces facing each other decreases at least partially along a mounting direction of the cover and the operating element;

wherein the cover comprises a top plate and a base plate facing said top plate, and said top and base plates are connected therewith by a frame;

wherein the frame has an open base section which is located at a base which forms a beginning for the mounting direction of the cover;

wherein the base plate includes an aperture extending from said beginning of the cover along the mounting direction;

wherein the open base section of the frame is closed by at least one flap;

wherein the at least one flap is a leaf spring which has one end linked to the cover and another end resting against the operating element.

* * * * *